United States Patent [19]

Buddenbohm

[11] Patent Number: 4,652,209

[45] Date of Patent: Mar. 24, 1987

[54] KNURLED TURBINE TIP SEAL

[75] Inventor: Harold W. Buddenbohm, Reseda, Calif.

[73] Assignee: Rockwell International Corporation, El Segundo, Calif.

[21] Appl. No.: 775,554

[22] Filed: Sep. 13, 1985

[51] Int. Cl.[4] ..... F01D 11/00

[52] U.S. Cl. ..... 415/174; 415/172 A

[58] Field of Search ..... 415/170 R, 172 A, 173 R, 415/174, 119, 172 R

[56] References Cited

U.S. PATENT DOCUMENTS

| | | | |
|---|---|---|---|
| 2,333,343 | 11/1943 | Sendzimir | 415/174 |
| 3,412,977 | 11/1968 | Moyer et al. | 415/174 |
| 3,487,519 | 1/1970 | Davidson | 415/174 |
| 3,529,905 | 9/1970 | Meginnis | 415/174 |
| 3,603,599 | 9/1971 | Laird | 277/53 |
| 3,843,278 | 10/1974 | Torell | 415/174 |
| 3,860,358 | 1/1975 | Cavicchi et al. | 415/174 |
| 3,880,435 | 4/1975 | Thornbald | 277/53 |
| 4,354,687 | 10/1982 | Holland et al. | 277/26 |
| 4,405,284 | 9/1983 | Albrecht et al. | 415/174 |
| 4,433,845 | 2/1984 | Shiembob | 415/174 |

FOREIGN PATENT DOCUMENTS

| | | | |
|---|---|---|---|
| 620723 | 5/1961 | Canada | 415/174 |

OTHER PUBLICATIONS

NASA Tech Brief 10607 Dec. 1967.

*Primary Examiner*—Robert E. Garrett
*Assistant Examiner*—John Kwon
*Attorney, Agent, or Firm*—H. Fredrick Hamann; Harry B. Field; Lawrence N. Ginsberg

[57] ABSTRACT

A turbine tip seal 10 for inhibiting fluid leakage between a turbine housing and the shroud 20 and runners 24 which are typically attached to turbine blade tips 18. The tip seal 10 has a resilient ring 28 and a plated layer 32. Plated layer 32 has a knurled inner surface 34. The knurled surface 34 allows only a small amount of fluid leakage between itself and the turbine blades 18 while maintaining high rotor stiffness.

8 Claims, 4 Drawing Figures

KNURLED TURBINE TIP SEAL

BACKGROUND OF THE INVENTION

1. Field of the Invention

This invention relates to turbine tip seals and especially to reducing leakage losses at the turbine wheel tips while increasing rotor stiffness.

2. Description of the Prior Art

Current tip seal designs for turbine wheels each have their own unique benefits and detriments. Straight, smooth inner bearing surfaces for turbine tip seals traditionally have been used. Straight seals provide a high amount of rotor stiffness; however, these seals also have a high rate of fluid leakage. The low cost of these seals makes them commercially attractive.

A second type of tip seal commonly used includes a honeycomb or cellular inner bearing surface. The cellular characteristics of this structure provides a tortuous, turbulent fluid path and hence a low fluid leakage rate; however, these cellular characteristics also result in a low amount of rotor stiffness. A primary benefit of employing honeycomb seals is that during operation of the turbine, in an out-of-balance condition, the turbine runners rub against the seal and the cells remain capable of performing the sealing function without catastrophic results. High manufacturing costs are associated with the fabrication of honeycomb tip seals because a brazed corrugated ribbon is used to form the honeycomb. The structure is then centrifugally brazed to a substrate material to prevent the honeycomb cells from being filled with brazing material.

OBJECTS OF THE INVENTION

An object of the invention is to minimize leakage between the tips of the turbine blades and the housing of the turbomachine.

Another object is to increase the amount of rotor stiffness.

Still another object is to provide a low cost, easily manufactured tip seal.

Other objects, advantages and novel features of the present invention will become apparent from the following detailed description of the invention when considered in conjunction with the accompanying drawing.

SUMMARY OF THE INVENTION

The present invention for inhibiting fluid leakage between a turbine housing and the outer circumferential edges of the turbine blades comprises a resilient ring disposed around said circumferential edges of the turbine blades and within the turbine housing. The resilient ring has a rough inner surface with random uniform roughness for providing a low rate of fluid leakage between the rough surface and the turbine blades while maintaining high rotor stiffness.

DETAILED DESCRIPTION OF THE DRAWINGS

The same elements or parts throughout the figures of the drawing are designated by the same reference characters.

DETAILED DESCRIPTION OF THE PREFERRED EMBODIMENTS

Figure 1:
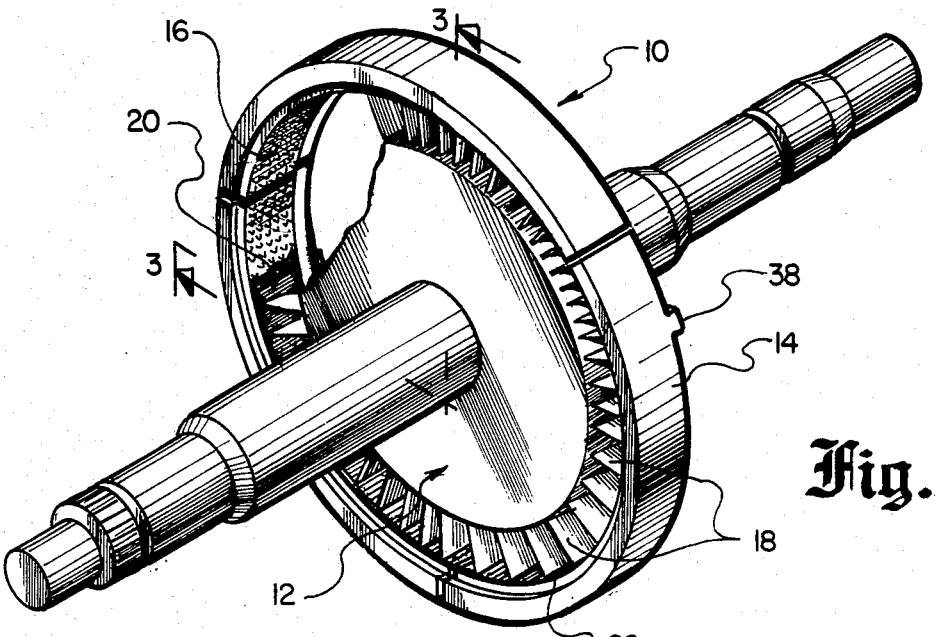
FIG. 1 is a perspective illustration of the turbine tip seal in relation to a turbine wheel.

Referring to the drawings and to the characters of reference marked thereon, FIG. 1 illustrates the turbine tip seal designated generally as 10, in relation with a turbine wheel assembly 12. Turbine tip seal 10 is comprised of a resilient ring assembly 14 with a roughened inner surface 16.

In use, tip seal 10 is located within the turbine housing (not shown) and around an outer circumferential edge of a plurality of turbine blades 18, which terminate in tips 22. Typically, a circular shroud 20 is attached to turbine blade tips 22 to improve turbine efficiency. Shroud 20 has a plurality of radially outward projecting circumferential runners 24 each of which has a relatively flat outer bearing surface 26. In the embodiment shown in FIG. 3, two runners 24 are utilized. Use of runners 24 reduces the bearing surface contact area and serves to prevent damage to the turbine blade tips 22.

Figure 2:
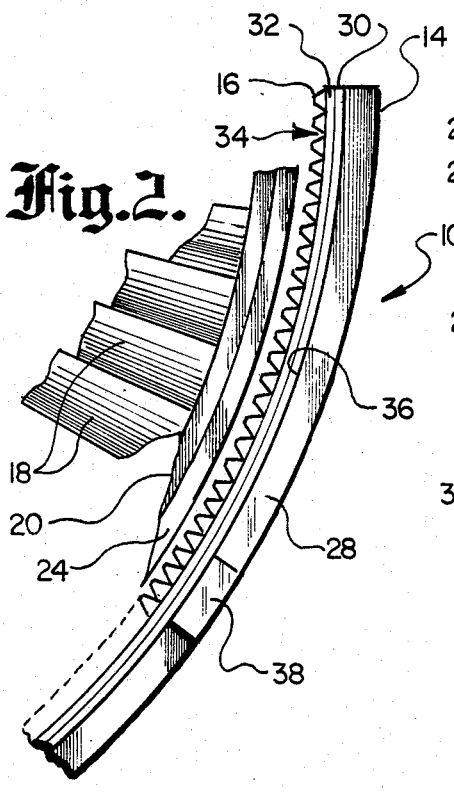
FIG. 2 is an end view of the turbine tip seal.
Figure 3:
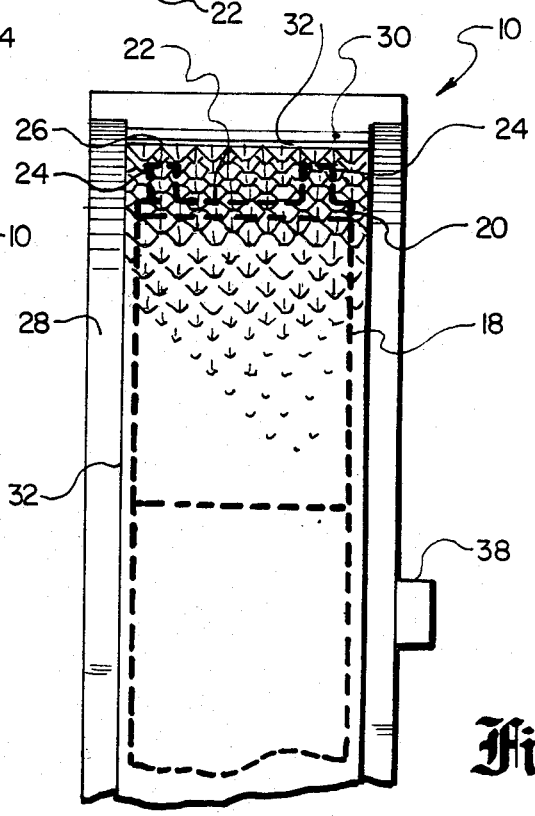
FIG. 3 is a section of FIG. 1 taken along cutting plane 3—3.
Figure 4:
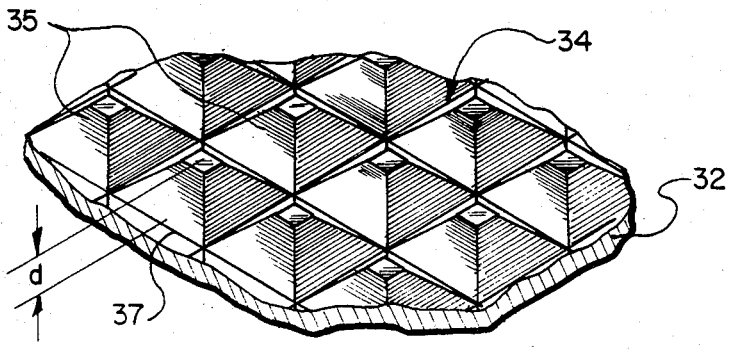
FIG. 4 is a partial perspective view of the uniformly roughened inner surface of the tip seal.

FIGS. 2–4 illustrate the preferred embodiment of the tip seal 10 of the present invention. In this embodiment, resilient ring assembly 14 includes a relatively wide portion 28, a more narrow, radially inward extending portion 30 and a layer 32 plated on an inner surface of the inward extending portion 30. The ring is preferably formed of a very hard metal such as Inconel. A softer metal, such as copper, nickel or silver is used for the plated layer 32. Use of a relatively soft metal for the plated layer 32 is required to forgive any turbine wheel contact due to instability.

The inner surface 34 of the plated layer 32 is knurled. It is a roughened surface having uniform roughness and is therefore effective in avoiding pressure differentials while providing a low-leakage rate and high rotor stiffness. A diamond knurl as shown in the figures is preferred. It may have either a male or female pattern. The male diamond pattern (which has raised points thus producing a female impression) is most easily manufactured because it can be produced by two diagonal knurls oriented in different directions. As shown most clearly in FIG. 4, the knurls are pyramidal elevations 35 which project inwardly from an inner surface 37 of layer 32 a distance, d. Typically distance, d, is from about 0.002 to 0.007 inches and is preferably 0.005 inches. Manufacture of a tip seal 10 using the knurled surface 34 of the present invention is relatively inexpensive because only conventional machining processes are required.

As shown in FIG. 1, the tip seal 10 may be segmented into a few separate arcuately shaped pieces with gaps between the pieces to prevent buckling from thermal expansion. If the tip seal 10 is segmented, as described, the inner surface 36 of the wide portion 28 and the side of the extending portion 30 form a region which, upon mating with the housing, serves as a pilot for maintaining radial centering of the tip seal relative to the housing.

The tip seal may also include axially extending tabs 38 which project from the ring 14 and which fit into corresponding slots within the housing. This engagement prevents relative rotation between the tip seal 10 and the housing. Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A turbine tip seal for inhibiting fluid leakage between a turbine housing and the outer circumferential edges of the turbine blades, comprising:

a resilient ring disposed around the circumferential edges of the turbine blades and within the turbine housing, said resilient ring having a rough inner metallic surface formed by a plurality of radially inwardly projecting truncated pyramidal elevations for providing a low rate of fluid leakage between said rough surface and the turbine blades while maintaining high rotor stiffness.

2. The turbine tip seal of claim 1, wherein:

a plated layer is formed on an inner surface of said resilient ring and wherein said rough inner surface is formed on said plated layer.

3. The turbine tip seal of claim 2, wherein:

said pyramidal elevations are on the order of about 0.002 to 0.007 inches in height.

4. The turbine tip seal of claim 2, wherein:

said rough inner surface is comprised of a diamond knurl pattern.

5. The turbine tip seal of claim 2, wherein:

said plated layer is comprised of copper.

6. The turbine tip seal of claim 2, wherein:

said resilient ring includes a relatively wide portion and narrow, radially inward extending portion, said plated layer being formed on an inner surface of said inward extending portion.

7. A turbine tip seal for inhibiting fluid leakage between a turbine housing and a circular shroud which is attached to the turbine blade tips, comprising:

a resilient ring disposed around the circumferential edge of said circular shroud, said ring including a relatively wide portion and a radially inward extending portion;

a relatively soft metallic plated layer formed on an inner surface of said radially inward extending portion said plated layer having a diamond knurled inner surface with uniform roughness for providing a low rate of fluid leakage between the tip seal and the circular shroud while maintaining high rotor stiffness; and, means for maintaining said resilient ring stationary with respect to said housing.

8. The turbine tip seal of claim 6, wherein said means for maintaining said resilient ring stationary with respect to said housing includes:

a plurality of axially extending tabs which engage with corresponding slots within said housing thus preventing relative rotation between said tip seal and said housing.

* * * * *